United States Patent [19]

Pajak et al.

[11] Patent Number: 4,711,451

[45] Date of Patent: Dec. 8, 1987

[54] REEL MAPPING SCHEME FOR A GAMING DEVICE

[75] Inventors: Phillip Pajak, Western Springs; Victor Salmons; Tony Chan, both of Chicago, all of Ill.

[73] Assignee: Bally Manufacturing Corporation, Chicago, Ill.

[21] Appl. No.: 891,362

[22] Filed: Jul. 29, 1986

[51] Int. Cl.[4] ..... A63B 71/04

[52] U.S. Cl. ..... 273/143 R; 273/138 A

[58] Field of Search ..... 273/143 R, 138 A, 1 E, 273/139, 143 B, 143 C, 143 D, 143 E

*Primary Examiner*—Richard C. Pinkham
*Assistant Examiner*—MaryAnn S. Lastova
*Attorney, Agent, or Firm*—Jenner & Block

[57] ABSTRACT

A reel mapping scheme which allows one standard reel stop control software routine to control the stopping of the reels when the device is operated as a standard gaming device, a multiple stop gaming device or a virtual reel gaming device. The gaming device includes a number of rotating symbol bearing reels, each reel having n stop positions associated with each symbol on the reel. For each reel, the gaming device stores a map of the symbols on the reel in a symbol map memory and a map of the stop positions on the reel in a stop map memory where the data stored in the first location in the reel map memory represents the first stop for a symbol whose data is stored in the first location in the symbol map memory. Three mapping indexes are stored for each reel. One index stores only one value representing an address offset to the reel map memory at one location for each symbol on the reel to provide a standard gaming device. A second index stores two or more reel map address offset values for each symbol on a reel to provide a multiple stop gaming device. A third index stores, for each of a number of symbols on a reel, the same reel map address offset value at different locations in the index to provide a virtual reel gaming device.

5 Claims, 6 Drawing Figures

REEL MAPPING SCHEME FOR A GAMING DEVICE

TECHNICAL FIELD

The present invention relates to a gaming device having one or more rotating symbol bearing reels each of which is stopped to display a randomly selected symbol along a win line and more particularly to a reel mapping scheme for such a gaming device which allows one standard reel stop control software routine to control the stopping of the reels when the device is operated as a standard gaming device, a multiple stop gaming device, a virtual reel gaming device or variations thereof.

BACKGROUND OF THE INVENTION

Gaming devices are known which include a number of rotating symbol bearing reels each of which is individually stopped to display a randomly selected symbol along a win line. If the symbols displayed along the win line form a winning combination, a prize is paid out to the player. Standard gaming devices of this type typically employ reels which have one stop position for each symbol on the reel, each stop position having one random number associated with it. To stop a reel in a standard gaming device, a random number is generated and the reel stopped at the stop position associated with the random number.

Multiple stop gaming devices are also known which employ reels having multiple stop positions for many of the symbols on the reel with the highest paying symbols having only one stop position. As in the standard gaming device, each stop position in a multiple stop gaming device has only one random number associated with it. To stop the reel in the multiple stop gaming device, a random number is generated and the reel stopped at the stop position associated with the random number as in the standard gaming device. However, the odds of winning by matching symbols having only one stop in a multiple stop game are less than those in a standard game so that larger prizes may be paid out to the player from a multiple stop gaming device than a standard device.

Virtual reel gaming devices are also known which employ reels typically having one stop position associated with each symbol on the display; however, a number of stop positions have multiple random numbers associated with them. As in the multiple stop gaming device, the odds of winning by matching symbols having only one associated random number in a virtual reel gaming device is less than the odds of winning in a standard gaming device so that larger prizes may be paid out to the player in a virtual reel gaming device than in a standard device.

To provide one game which is played as a standard type game, multiple stop type game or virtual reel type game, gaming device manufacturers must develop different reel stop controls including different software routines for each game type. The software development for the different types of games is extremely costly.

SUMMARY OF THE INVENTION

In accordance with the present invention, the disadvantages of prior gaming devices as discussed above have been overcome. The gaming device of the present invention employs a reel mapping scheme which allows one standard reel stop control software routine to control the stopping of the reels when the device is operated as a standard gaming device, a multiple stop gaming device, a virtual reel gaming device or variations thereof.

More particularly, the gaming device of the present invention includes a number of rotating symbol bearing reels, each reel having n stop positions associated with each symbol on the reel. For each reel, the gaming device includes a reel map memory for storing, for each stop on the reel, data representing the stop. The data for each stop is stored in the reel map memory at an addressable location corresponding to the location of the stop on the reel to provide a map of the reel stops. The data storage location for each stop has an associated, unique address offset value, k, which differs from the k offset value associated with the storage locations of adjacent stops for the same symbol by a unit value. The gaming device also includes for each reel a symbol map memory which stores, for each symbol on the reel, data representing the symbol. The data for each symbol is stored in the symbol map memory at an addressable location corresponding to the location of the symbol on the reel to provide a map of the reel's symbols. The symbol map memory data storage location for each symbol has an associated symbol address offset equal to k/n without the remainder, where k is one of the n reel map offset values associated with the symbol's n stops. A mapping index memory is also provided for each reel to store one or more of the reel map's k offset values for each symbol on the reel where each k offset value stored in the mapping index memory points to the symbol in the symbol map memory whose associated symbol address offset is equal to k/n without the remainder. Each k offset value stored in the mapping index also has an associated index offset value.

In order to stop a reel, the gaming device includes a random number generator for generating a random number representing an index offset value for the mapping index memory. A reel stop control mechanism is provided to stop the reel at the stop position whose associated k offset value is the value stored in the mapping index at the address having the index offset value represented by the random number generated in order to display along the win line the symbol whose associated symbol address offset value is equal to k/n without the remainder.

In order to operate the gaming device of the present invention as a standard gaming device, the mapping index for each reel stores a k offset value at only one location in the index for each symbol on the reel such that one random number is generated to point to only one of the n stops for each symbol. In order to operate the gaming device as a multiple stop gaming device, the mapping index for each reel stores two or more different k offset values for a number of the symbols on the reel such that more than one of the n stops is used for those symbols. To provide a virtual reel gaming device, for each of a number of symbols on the reel the mapping index stores the same k offset value at different locations in the index such that multiple random numbers are generated to point to the same stop for a symbol on the reel.

Because the same reel stop control software routine is employed to control the stopping of the reels when the device is operated as a standard gaming device, a virtual reel gaming device or a multiple stop gaming device, the costs of manufacturing one game, which may be played as any one of the three game types, are substantially reduced. These and other objects and advantages of the invention, as well as details of an illustrative embodiment, will be more fully understood from the following description and the drawings.

BEST MODE FOR CARRYING OUT THE INVENTION

Figure 1:
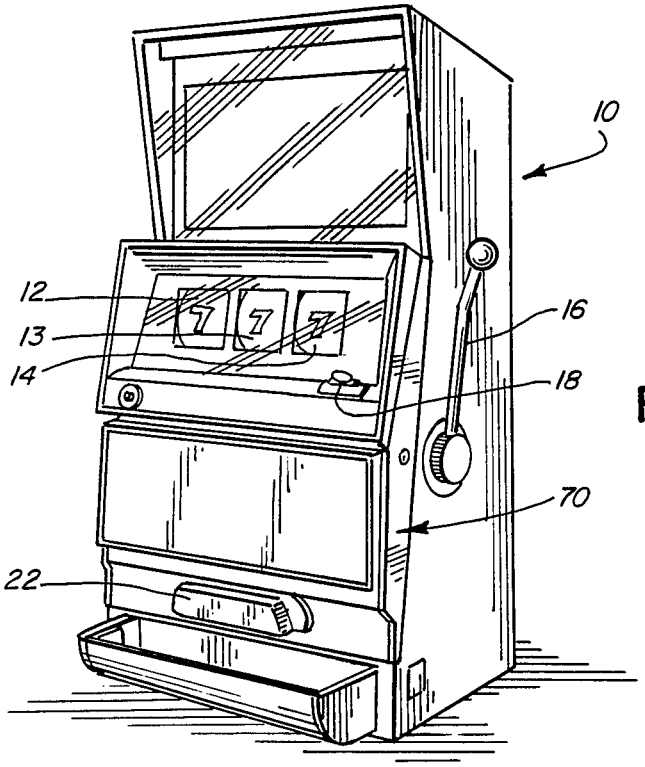
FIG. 1 is a perspective view of a gaming device employing the reel mapping scheme and standard reel stop control software routine of the present invention.
Figure 2:
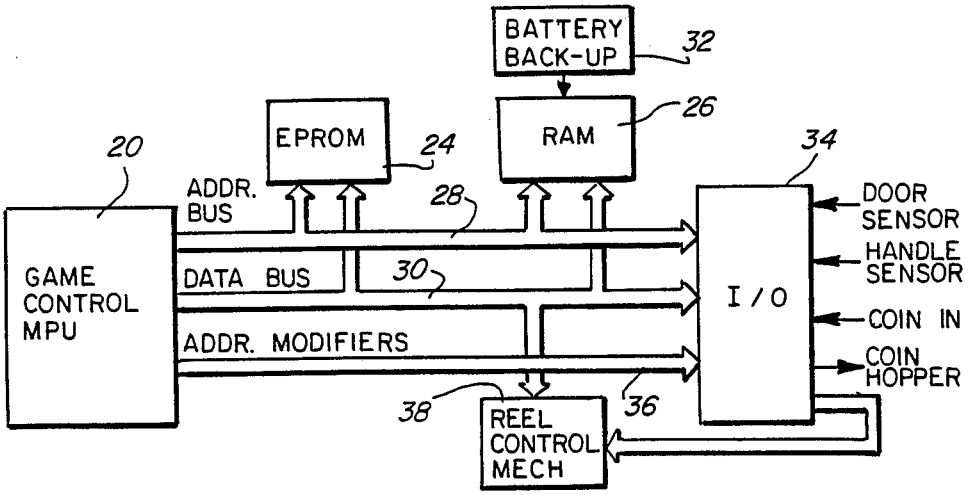
FIG. 2 is a block diagram of the gaming device of FIG. 1.

A gaming device 10 employing the reel mapping scheme of the present invention is shown in FIG. 1. The gaming device 10 includes three symbol bearing reels 12, 13 and 14 which are controlled to rotate in response to the pulling of a handle 16 after a coin is inserted into a coin input slot 18. The gaming device 10 includes a game control microprocessor 20, as shown in FIG. 2, which stops each of the reels 12–14 to display three randomly selected symbols along a win line. If the symbols displayed along the win line form a winning combination, the microprocessor 20 causes the coin hopper to payout, through a payout chute 22 a number of coins or tokens.

The game control microprocessor 20, shown in FIG. 2, is preferably a Motorola 68,000 processor. The processor 20 controls the operation of the gaming device 10 in accordance with software and data stored in an EPROM 24 and RAM 26. The EPROM 24 and RAM 26 are coupled to the processor 20 by an address bus 28 and a data bus 30. To ensure that no data stored in the RAM 26 is lost during a power failure, the RAM 26 is coupled to a battery backup circuit 32. The game control microprocessor 20 is also coupled to various input sensors and devices as well as the coin hopper through an input/output board 34 which is coupled to the processor 20 through the address and data buses 28 and 30 and an address modifier line 36. In order to address the input/output board 34, the game control processor 20 must output the correct address modifiers for the input-/output board on line 36 as well as the address for the input/output board on the address bus 28. The game control microprocessor 20 controls each of the reels 12–14 through a reel control mechanism 38 which is coupled to the data bus 30 to receive data therefrom. The reel control mechanism 38 may include a stepper motor or the like for each of the reels 12–14 to start and stop the rotation of the reels in accordance with the data on bus 30 from the game control microprocessor 20. The reel control mechanism is also coupled to the input-/output board 34 which is responsive to the microprocessor 20 for selecting a particular one of the stepper motor controls to receive data from the bus 30.

Figure 3:
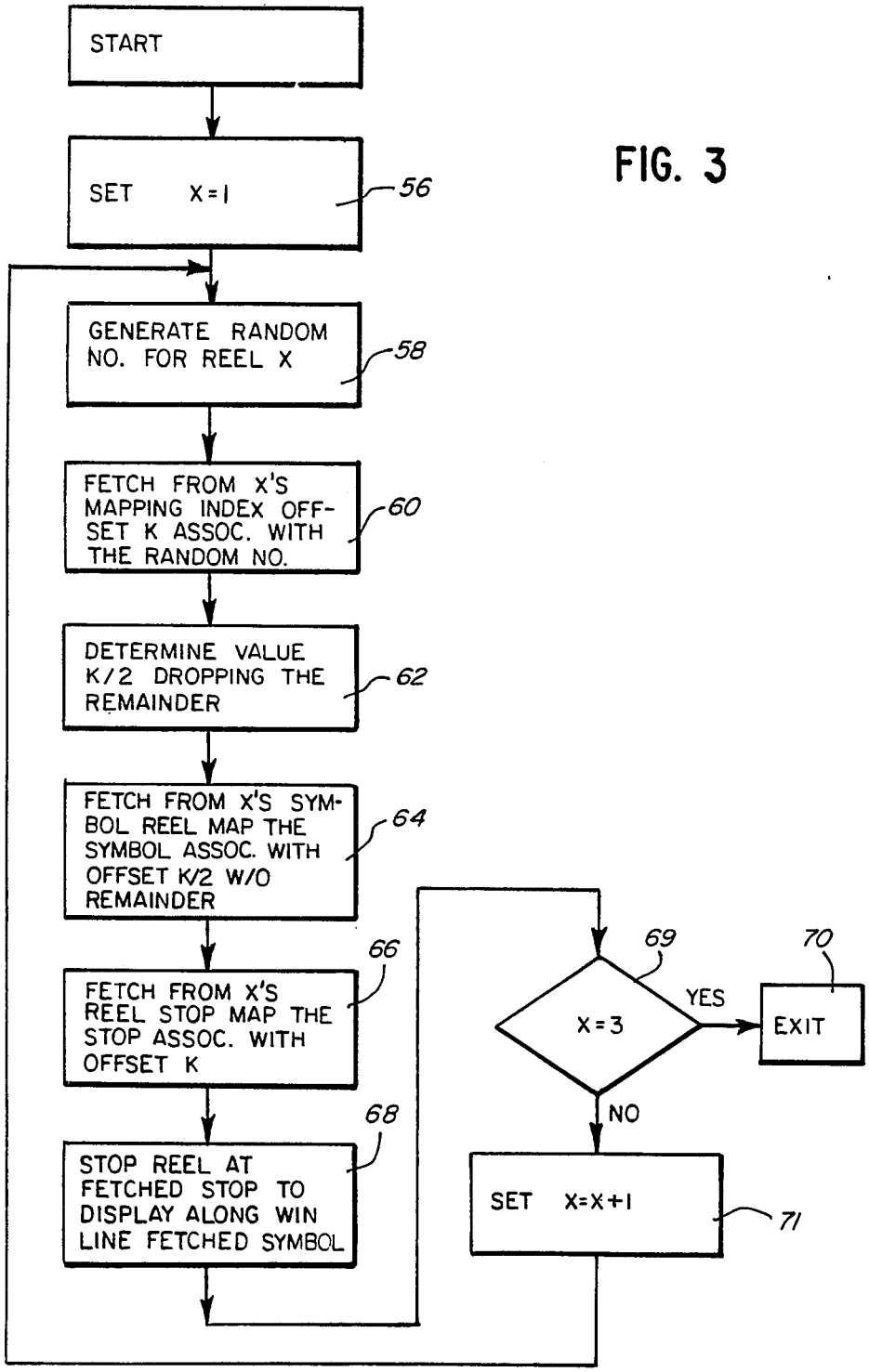
FIG. 3 is a flowchart illustrating the reel stop control software routine of the present invention.
Figure 4:
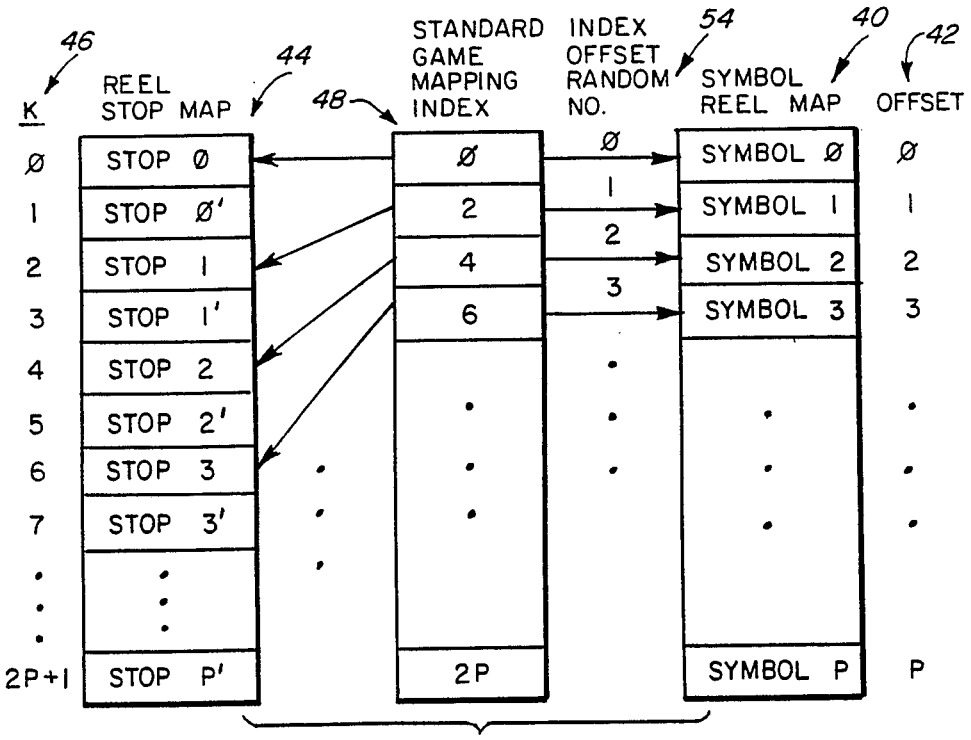
FIG. 4 is a memory map illustrating the reel stop map, mapping index, and symbol reel map of the present invention for a standard game.
Figure 5:
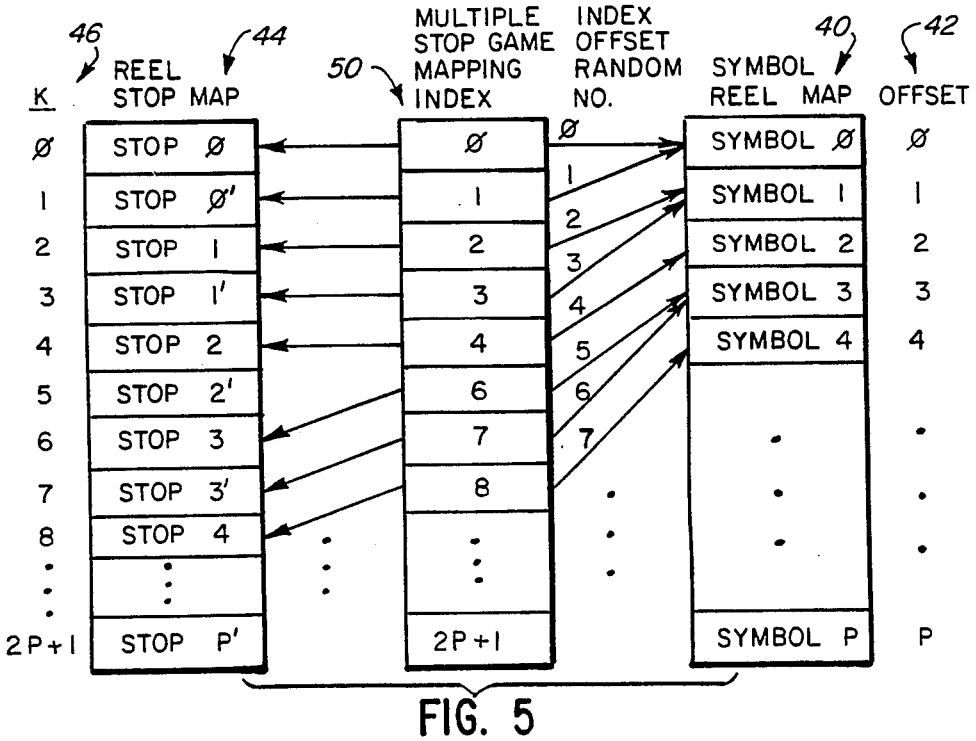
FIG. 5 is a memory map illustrating the reel stop map, mapping index and symbol reel map of the present invention for a multiple stop game.
Figure 6:
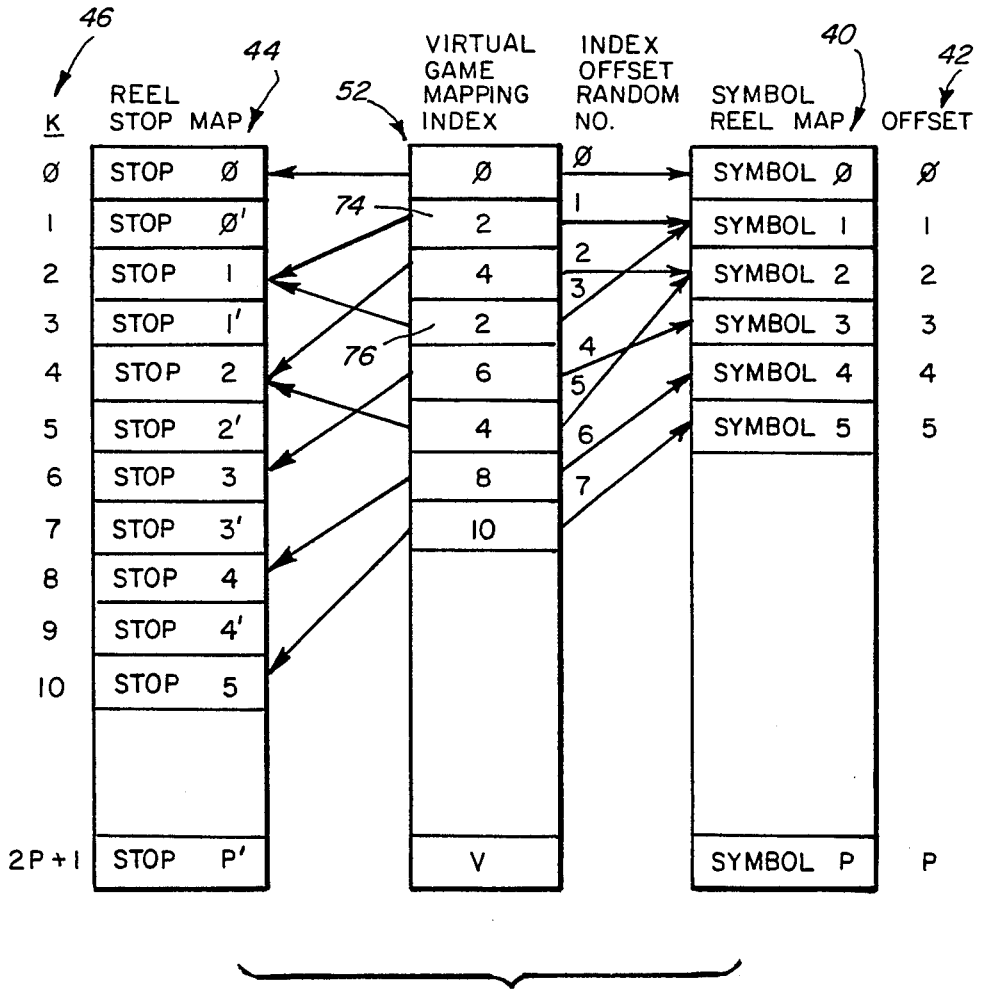
FIG. 6 is a memory map illustrating a reel stop map, mapping index and symbol reel map of the present invention for a virtual reel game.

More particularly, the microprocessor 20 controls the starting and stopping of each of the reels 12–14 according to a software routine illustrated in the flowchart of FIG. 3 which employs one of the memory map configurations depicted in FIGS. 4–6 for a standard game, multiple stop game and a virtual reel game respectively. To operate as any one of the three game types, standard, multiple stop or virtual reel, each of the reels 12–14 of the gaming device 10 has n stop positions for each symbol depicted on the reel. When the microprocessor 20 stops a reel at a particular stop position, the symbol associated with that stop position is displayed along a win line. Although n is set equal to 2 in the memory maps of FIGS. 4–6 so that there are two stop positions for every symbol on a reel, n may be any integer value.

Each of the memory configurations of FIGS. 4–6 has an associated reel stop memory map, a symbol reel memory map and a mapping index. The reel stop memory map and symbol stop memory map are the same for each of the configurations; however, the mapping index for each configuration varies. Although three different mapping indexes must be stored for each reel in the EPROM 24 for one gaming device 10 which is capable of operating as all three game types, only one reel stop map and symbol reel map are needed and stored in the EPROM for each reel.

Each of the symbol reel memory maps 40 stores data representing each symbol on a reel at a location in the map corresponding to the location of the symbol on the reel to provide a map of the symbols on the reel. For a reel having P+1 symbols, the symbol reel memory map has P+1 data storage locations labeled SYMBOL O–SYMBOL P. The storage location labeled SYMBOL O stores data representing a first symbol on the reel, the storage location labeled SYMBOL 1 storing data representing a second symbol on the reel where the second symbol is located on the reel adjacent to the first symbol and so on such that the storage location labeled SYMBOL P stores data representing the P+1 symbol on the reel which symbol is located on the reel between the P symbol (whose data is stored at location SYMBOL P−1) and the first symbol (whose data is stored at location SYMBOL O).

Each of the storage locations SYMBOL O–SYMBOL P in the symbol reel memory map 40 has an associated symbol address offset 42 ranging from O–P. The address of the storage location SYMBOL O in map 40 for the first symbol is taken as a reference from which the addresses of each of the other storage locations in the map are offset, the symbol address offset for the location SYMBOL O being zero. The symbol address offsets vary by a unit value so that the symbol address offset for storage location SYMBOL 1 is 1, the offset for the storage location SYMBOL 2 being 2 and so on such that the offset for the storage location SYMBOL P is P.

Each of the reel stop memory maps 44 stores data representing each stop position on a given reel at a location in the map corresponding to the location of the stop on the reel to provide a map of the stops on the reel. For a reel having P+1 symbols, the reel stop map has n(P+1) data storage locations. As shown in FIGS. 4–6, for a reel having two stop positions for each symbol, there are 2(P+1) data storage locations labeled STOP 0–STOP P'. The storage location labeled STOP 0 stores data representing the first stop for the first symbol whose data is stored in the symbol reel map 40 at the storage location SYMBOL 0. The storage location labeled STOP 0' in map 44 stores data representing the second stop for the first symbol whose data is stored in the symbol reel map 40 at location SYMBOL 0. Similarly, the storage locations STOP 1 and STOP 1' in the reel stop map 44 store data respectively representing the first and second stops of the second symbol whose data is stored in the symbol reel map 40 in the storage location SYMBOL 1. In general, the storage locations STOP X and STOP X' in the reel stop map 44 store data respectively representing the first and second stop positions for the symbol whose data is stored in the symbol reel map 40 in the storage location SYMBOL X.

Each of the storage locations STOP 0–STOP P' in the reel stop memory map 44 has an associated address offset value k 46 ranging from 0 to 2P+1. The address for the storage location STOP O for the first stop for the first symbol on the reel is taken as a reference address from which the addresses of each of the other storage locations in the map 44 is offset so that the address offset k for the storage location STOP O is equal to 0. The k address offset values vary by a unit value so that the k address offset value for STOP O' is 1, the k address offset value for STOP 1 being 2 and so on such that the k address offset value for STOP P' is equal to 2P+1.

The offset values k for the reel stop memory map 44 are related to the symbol address offset values 42 such that the symbol address offset value 42 for a symbol is equal to k/n, without the remainder, where k is one of the n reel map offset values associated with the symbol's n stops. For example, data for the third symbol on the reel is stored at storage location SYMBOL 2 in map 40 which has a symbol address offset of 2. The data for the first and second stops associated with the third symbol are stored at locations STOP 2 and STOP 2' having respectively associated k offset values of 4 and 5. For k=4, the offset for the third symbol's first stop, k/n, is equal to 4/2=2 which is the symbol address offset for the third symbol whose data is stored at location SYMBOL 2 in the map 40. Similarly, for k=5, the offset for the third symbol's second stop, k/n, is equal to 5=2 with the remainder dropped which again is the symbol address offset for the third symbol in the map 40.

The mapping index for each of the memory configurations illustrated in FIGS. 4–6 stores one or more k offset values for each symbol on a reel where each k offset value stored in the mapping index points to symbol data in the symbol reel map whose associated symbol address offset equals k/n without the remainder. Each k offset value is stored in the mapping index at a location having an associated index offset value. To stop a reel to display a randomly selected symbol, the microprocessor 20, as discussed in detail below, generates a random number which represents an index offset associated with a particular storage location in the mapping index and the k offset value stored therein. The k offset value associated with the generated random number/index offset in the mapping index points to a particular stop in the reel stop map 44 and to a particular symbol in the symbol reel map 40 such that the stop pointed to is a stop associated with the symbol pointed to.

In the mapping index 48 for a standard game as illustrated in FIG. 4, the mapping index stores a k offset value at only one location in the index for each symbol on the reel such that one unique index offset value points to only one of the n stops for each symbol on a reel. More particularly, the mapping index 48 for a standard game stores even k offset values 0 through 2P. The first storage location in the index 48 storing the k offset, 0, has an associated index offset 54 having a value of 0. The second storage location in the mapping index 48 stores a k offset value of 2 having an associated index offset value of 1 and so on such that the k offset value, 2P stored in the P+1 storage location in the mapping index 48 has an associated index offset of P. As seen in FIG. 4, each k offset value stored in the mapping index 48 points only to the first stop associated with each symbol on the reel.

The mapping index 50 for a multiple stop game as shown in FIG. 5 stores two or more different k offset values for a number of symbols on the reel such that more than one of the n stops is used for those symbols. As shown in the mapping index 50, the k offset values 0–3 are stored in the first four storage locations so that for the first two symbols whose data is stored respectively in the map 40 at locations SYMBOL 0 and SYMBOL 1, there are two possible stop positions associated with each symbol. Stop positions 1 and 2 whose data is stored in the locations STOP 0 and STOP 0' of the map 44 are the stop positions associated with the symbol whose data is stored in the location SYMBOL 0. The first and second stops whose stop position data is respectively stored at locations STOP 1 and STOP 1' in map 44 are associated with the second symbol whose data is stored at location SYMBOL 1 in map 40. The third symbol on the reel whose data is stored in the map 40 at storage location SYMBOL 2, has only one stop associated therewith whose data is stored at the storage location in map 44 at STOP 2 having an associated k offset value of 4. Because only one of the two stops may be used for the symbol whose data is stored in map 40 at SYMBOL 2, the k offset value of 5 is not stored in the mapping index 50.

The mapping index 52 for a virtual reel game as shown in FIG. 6 stores for each of a number of symbols on the reel the same k offset value at different locations in the index such that multiple random numbers each associated with a different storage location in the index are generated to point to the same stop for a symbol on the reel. For example, the k offset value 2 is stored in the storage location 74 of the mapping index 52 and is also stored in the fourth storage location 76 in the index 52. Each of the k offset values 2 stored at the storage locations 74 and 76 in the map 52 points to the first stop whose stop position data is stored in map 44 at storage location STOP 1 for the second symbol on the reel whose data is stored in map 40 at the storage location SYMBOL 1. Although only even numbers are randomly stored in the mapping index 52 for the virtual reel game 56 so that only one stop for each symbol on the reel is employed, a virtual reel mapping index pointing to multiple stops could also be employed by combining the teachings of the mapping index illustrated in FIGS. 5 and 6.

At the start of a reel stopping operation for a standard game as shown with reference to FIGS. 3 and 4, the microprocessor 20, at a block 56, sets the reel number X equal to 1 to stop the first reel, reel 12, at a stop position to display a randomly selected number. The microprocessor next, at block 58, generates a random number for reel 12 which represents an index offset value for the mapping index 48. At block 60, the microprocessor 20 fetches from reel 12's standard game mapping index the k offset value associated with the random number generated at block 58. For example, if the random number generated at block 58 for reel 12 is equal to 3, at block 60 the microprocessor fetches the k offset value 6 from the mapping index 48. The microprocessor then determines, at block 62, the value of k/2 without the remainder. In the example where the random number 3 is generated at block 58 so that the k offset value equals 6, k/2=6/2=3. At block 64, the microprocessor 20 fetches from reel 12's symbol reel map 40 the symbol data associated with the offset k/2 dropping the remainder. In the example above where the symbol address offset equals 6/2=3, the data stored in the storage location SYMBOL 3 in the map 40 is fetched. Then at block 66, the microprocessor 20 fetches from reel 12's reel stop map 44 the stop data associated with the k offset value determined at block 60. In the above example, the k offset value is equal to 6 so that the data stored at the storage location STOP 3 in the map 44 is fetched at block 66. At block 68, the microprocessor 20 through the reel control mechanism 38 stops the reel 12 at the first stop whose data is stored at STOP 3 in map 44 for the fourth symbol whose data is stored in the map 40 at location SYMBOL 3. At block 69, the processor 20 determines whether each of the three reels have been stopped such that X=3 and if so, the microprocessor 20 exits the subroutine at block 70. If not, at block 71, X is set equal to X+1 and the processor returns to block 58 to stop the next reel.

For the multiple stop game mapping index 50 shown in FIG. 5, even and odd numbers are stored therein such that two k offset values are stored in the mapping index 50 for a number of symbols so that more than one of the two available stops is used for those symbols. If the random number 3 is generated at block 58 shown in FIG. 3 for a gaming device 10 having the memory map configuration of FIG. 5, at block 60, the microprocessor 20 fetches from the reel's mapping index 50 the k offset value 3 associated with the index offset value 3 represented by the random number. At block 62, the microprocessor determines that the value of k/2 dropping the remainder is equal to 3/2 without the remainder or 1 to point to the symbol data in map 40 whose associated offset is 1. At block 64, the microprocessor then fetches from the reel's symbol reel map 40 shown in FIG. 5 the data stored at the storage location SYMBOL 1 having the associated offset value of 1. Then at block 66, the microprocessor 20 fetches from the reel stop map 44, the stop data associated with the k offset value 3 whose data is stored at location STOP 1'. The microprocessor 68 through the reel control mechanism 38 then stops the reel at the second stop identified by the data stored in the map 44 at STOP 1' for the second symbol on the reel whose data is stored in the storage location SYMBOL 1 of map 40.

As shown in FIG. 3 for a virtual reel game, the microprocessor 20 again generates a random number for a given reel at block 58, which random number in the above examples has been 3. At block 60, the processor 20 fetches from the reel's virtual reel mapping index 52, the k offset value 2 stored at the storage location 56 whose associated index offset or random number is equal to 3. At block 62, the value of k/2 without the remainder is determined to be 2/2=1 so that at block 64, the processor 20 fetches from the symbol reel map 40 shown in FIG. 6 the symbol data stored in map 40 in the storage location SYMBOL 1 for the second symbol on the reel. At block 66, the processor 20 then fetches from the reel stop map 44 the stop data stored at the storage location STOP 1 whose associated k offset value is equal to 2. At block 68, the processor 20 stops the reel at the first stop for the second symbol whose stop position data is stored in the location STOP 1 of map 44 and whose symbol data is stored at the location SYMBOL 1 of map 40.

As can be seen from the above descriptions of FIGS. 3–6, the same random number will stop a reel at various stop positions on the reel to display different symbols along the even line depending on the type of memory configuration employed.

We claim:

1. In a gaming device having a rotating symbol bearing reel with n stop positions associated with each symbol, a control system for stopping said reel to display a randomly selected symbol along a win line comprising:

reel map means for storing, for each stop on the reel, data representing the stop at an addressable location in the reel map means corresponding to the location of the stop on the reel to provide a map of the reel stops, the data storage location for each stop having an associated, unique address offset value k which differs from the k offset values associated with an adjacent stop or stops for the same symbol by a unit value;

symbol map means for storing, for each symbol on said reel, data representing the symbol at an addressable location in the symbol map means corresponding to the location of the symbol on the reel to provide a map of the symbols, the data storage location for each symbol having an associated, symbol address offset equal to k/n without the remainder where k is one of the n reel map offset values associated with the symbol's n stops;

mapping index means for storing one or more k offset values for each symbol on said reel where each k offset value stored in the index means points to the symbol in the symbol map means whose associated symbol address offset equals k/n without the remainder, each k offset value being stored in the mapping index means at a location having an associated index offset value;

means for randomly generating a number representing an index offset value for said mapping index means; and means for stopping said reel at the stop position whose associated k offset value is the value stored in the mapping index means at the address having the index offset value represented by said random number to display along the win line the symbol whose associated symbol address offset value is equal to k/n without the remainder.

2. The gaming device of claim 1 wherein said mapping index stores a k offset value at only one location in the index for each symbol on said reel such that one random number is generated to point to only one of the n stops for each symbol on the reel.

3. The gaming device of claim 1 wherein said mapping index stores two or more different k offset values for a number of the symbols on the reel such that more than one of the n stops is used for said number of symbols.

4. The gaming device of claim 1 wherein said mapping index stores for each of a number of symbols on the reel the same k offset value at different locations in the index such that multiple random numbers are generated to point to the same stop for a symbol on the reel.

5. In a gaming device having a rotating symbol bearing reel with n stop positions associated with each symbol, a control system capable of operating the gaming device as a standard device, multiple stop device and a virtual reel device when stopping the reel to display a randomly selected symbol along a win line comprising:

reel map means for storing, for each stop on the reel, data representing the stop at an addressable location in the reel map means corresponding to the location of the stop on the reel to provide a map of the reel stops, the data storage location for each stop having an associated, unique address offset value k which differs from the k offset values associated with an adjacent stop or stops for the same symbol by a unit value;

symbol map means for storing, for each symbol on said reel, data representing the symbol at an addressable location in the symbol map means corresponding to the location of the symbol on the reel to provide a map of the symbols, the data storage location for each symbol having an associated symbol address offset equal to k/n without the remainder where k is one of the n reel offset values associated with the symbol's n stops:

standard game mapping index means for storing only one k offset value for each symbol on said reel at only one storage location where each k offset value stored in said index means points to the symbol in the symbol map means whose associated symbol address offset equals k/n without the remainder, each k offset value being stored in the mapping index means at a location, the address of which has an associated index offset value;

multiple stop game mapping index means for storing two or more different k offset values for a number of the symbols on the reel where each k offset value stored in said index means points to the symbol in the symbol map means whose associated symbol address offset equals k/n without the remainder, each k offset value being stored in the mapping index means at a location, the address of which has an associated index offset value;

virtual reel game mapping index means for storing, for each of a number of symbols on the reel, the same k offset value at different storage locations in the index means where each k offset value points to the symbol in the symbol map whose associated symbol address offset equals k/n without the remainder, each storage location in the index means having an address with an associated index offset value;

means for randomly generating a number representing an index offset value; and means for stopping said reel at the stop position whose associated k offset value is the value stored in the standard game mapping index means, multiple stop game mapping index means or virtual reel game mapping index means at the address having the index offset value represented by said random number to display along the win line the symbol whose associated symbol address offset value is equal to k/n without the remainder.

* * * * *